US006142242A

United States Patent [19]

Okumura et al.

[11] Patent Number: 6,142,242

[45] Date of Patent: Nov. 7, 2000

[54] PERCUSSION DRIVER DRILL, AND A CHANGEOVER MECHANISM FOR CHANGING OVER A PLURALITY OF OPERATING MODES OF AN APPARATUS

[75] Inventors: Michio Okumura; Takefumi Furuta; Takao Kuroyanagi; Hidenori Ito, all of Anjyo, Japan

[73] Assignee: Makita Corporation, Anjyo, Japan

[21] Appl. No.: 09/503,243

[22] Filed: Feb. 14, 2000

[30] Foreign Application Priority Data

Feb. 15, 1999 [JP] Japan ..... 11-035880
Feb. 15, 1999 [JP] Japan ..... 11-035922

[51] Int. Cl.[7] ..... B25B 23/159

[52] U.S. Cl. ..... 173/48; 173/216

[58] Field of Search ..... 173/48, 216, 178, 173/104, 109

[56] References Cited

U.S. PATENT DOCUMENTS

| | | | |
|---|---|---|---|
| 4,274,304 | 6/1981 | Curtiss | 173/48 |
| 5,339,908 | 8/1994 | Yokota et al. | 173/216 |
| 5,458,206 | 10/1995 | Bourner et al. . | |
| 5,531,278 | 7/1996 | Lin | 173/48 |
| 5,550,416 | 8/1996 | Fanchang et al. | 173/216 |
| 5,692,575 | 12/1997 | Hellstrom | 173/216 |
| 5,842,527 | 12/1998 | Arakawa et al. | 173/48 |

FOREIGN PATENT DOCUMENTS

| | | |
|---|---|---|
| 195 45 260 A1 | 11/1995 | Germany . |
| 3004054 | 8/1994 | Japan . |
| 6-339868 | 12/1994 | Japan . |

*Primary Examiner*—Scott A. Smith
*Attorney, Agent, or Firm*—McGinn & Gibb, P.C.

[57] ABSTRACT

A pair of stoppers (47) capable of moving back and forth in an axial direction of a spindle (5) are provided on an outer periphery of a tubular portion (9*a*) for supporting the spindle (5). As a pair of projections (49) provided on a first change ring (32) are moved in conjunction with the rotation of the first change ring (32) which is capable of changing over the operating mode of a percussion driver drill, the stoppers (47) move back and forth in the axial direction. During a percussion mode and a drill mode, the stoppers (47) abut against a flat washer (50) for fixing an internal gear (13) to restrict the forward movement of the flat washer (50), while, during a clutch mode provided in the first change ring (32) as a third changeover position, the stoppers (47) move away from the flat washer (50). A pair of washers (40, 41) superposed on each other in the axial direction of the spindle (5) are interposed between the first change ring (32) and a second change ring (39). The washer (40) has a click (45) capable of engaging in one of recesses (59) formed in the first change ring (32). The washer (41) has a click (46) capable of engaging in one of recesses (58) formed in the second change ring (39).

7 Claims, 9 Drawing Sheets

62
9
57
57
42
50
9a
51
56
55
53
54
57
42
51
42
39
58
52
54
58
58
43
43
43
45
43
44
46
41
43
44
40
43
47
48
47
48
59
59
59
32
36
49
49
36

PERCUSSION DRIVER DRILL, AND A CHANGEOVER MECHANISM FOR CHANGING OVER A PLURALITY OF OPERATING MODES OF AN APPARATUS

BACKGROUND OF THE INVENTION

1. Field of the Invention

The present invention relates to a percussion driver drill capable of effecting a changeover among a plurality of operating modes thereof. Furthermore, the present invention also relates to a changeover mechanism for changing over a plurality of operating modes of an apparatus such as a power tool, a motor-driven device, an electric equipment, etc.

The present application is based on Japanese Patent Applications Nos. Hei. 11-35880 and Hei. 11-35922, which are incorporated herein by reference.

2. Description of the Related Art

A percussion driver drill is known as one of power tools. As the structure for changing over the operating mode of a percussion driver drill, a structure is known in which, as disclosed in Unexamined Japanese Patent Publication No. Hei. 6-339868, a cam mechanism, which is comprised of a rotating ratchet secured on a spindle and provided with ratchet teeth in an axial direction as well as a fixed ratchet fitted loosely over the spindle and having similar ratchet teeth formed on its surface opposing the rotating ratchet so as to be prevented from rotating, is controlled by a first changeover member such as a ring member or a lever. Namely, in a first changeover position of the first changeover member, the fixed ratchet moves toward the rotating ratchet side to cause their ratchet teeth to interfere with each other, whereby, in addition to rotation, axially percussing motion is applied to the spindle (percussion mode). Meanwhile, in a second changeover position, the fixed ratchet moves away from the rotating ratchet, so that only rotation is applied to the spindle (drill mode).

In addition, in the aforementioned publication, a torque adjusting mechanism is also adopted in which, in a planetary gear reduction mechanism disposed in a stage preceding the spindle, one of internal gears meshing with a periphery of a planetary gear is made rotatable inside a housing, and this internal gear is pressed and fixed by a pressing mechanism including steel balls, washers, and a coil spring, wherein if the load on the spindle increases, the internal gear is caused to idle to cut off the transmission of rotation of the spindle. The setting of the torque is possible by changing the pressing force of the coil spring by rotatively operating a second changeover member such as a ring member meshing with the housing and supporting a front end of the coil spring.

Meanwhile, also disclosed in the aforementioned publication is an arrangement in which the changeover of the cam mechanism and the changing of the pressing force of the coil spring are made possible by a single changeover member.

When the percussion driver drill is to be used in the percussion mode and the drill mode, in addition to the operation of changing over the operating mode by the first changeover member, the operation of the second changeover member is required in order to maximize the torque so that the internal gear does not idle easily due to the load. To the contrary, when the percussion driver drill is to be used for screwdriving or the like from the percussion or drill mode, in addition to the changeover operation to the drill mode by the first changeover member, it is necessary to operate the second changeover member again to a desired torque from the maximum torque so that torque adjustment functions.

Thus, when the percussion driver drill is used selectively between the percussion or drill mode and the torque adjustment, the operation of the two changeover members is always required, so that the handling of the percussion driver drill has been troublesome, and the ease of its use has been poor.

On the other hand, also in a case where both the changeover of the operating mode and the torque adjustment are effected by one changeover member, in the alternate use for drilling and screwdriving, there are cases where the percussion driver drill is used by alternately rotating the changeover member (here, a change ring) by maximum amounts clockwise and counterclockwise, so that the ease of its use has been poor.

In addition, with the percussion driver drill, there are cases where the changeover of the operating mode among such as the percussion mode and the drill mode as well as the torque adjustment are respectively effected by using separate changeover members. For example, in Registered Japanese Utility Model No. 3004054, a percussion driver drill is disclosed in FIGS. 8 and 9 in which a dial-type first changeover member for changing over the operating mode between the percussion mode and the drill mode and a dial-type second changeover member for adjusting the torque of the spindle are disposed at forward and backward positions in the axial direction in front of the housing, and as each of these changeover members is rotatively operated, selection of the operating mode or torque is made possible.

In the percussion driver drill thus provided with the changeover members, clicking mechanisms using such as a leaf spring and balls are provided to improve the operational efficiency by providing positioning in predetermined rotational positions. However, the two changeover members are often spaced apart from each other so as to indicate marks for the rotated positions between the two changeover members, or the clicking mechanisms are often disposed separately on the front and rear sides of the two changeover members partly because the number of clicking pieces differs between the first changeover member and the second changeover member (in the aforementioned publication, two clicking pieces are provided in the first changeover member, and six clicking pieces are provided in the second changeover member). Consequently, there have been problems in that the structure becomes complex and the cost becomes high, and that the space for the clicking mechanisms becomes large, making the percussion driver drill elongated in the axial direction.

SUMMARY OF THE INVENTION

Accordingly, it is a primary object of the present invention to provide a percussion driver drill which uses two changeover members in the selection of the operating mode and does not require the operation of the second changeover member in the percussion and drill modes, and which therefore improves the operational efficiency involved in the selection of the operating mode, and excels in the ease of use.

To achieve the above primary object, according to the first aspect of the present invention, there is provided a percussion driver drill which comprises a main body housing to which a motor is attached, a planetary gear reduction mechanism assembled to the main body housing, the planetary gear reduction mechanism having an internal gear rotatably disposed therein, an input end capable of being mounted on the motor, and an output end from which a rotational force is transmissible to a spindle, a cam mechanism capable of applying percussing motion to the spindle in an axial direction thereof in interlocking relation to the spindle, a pressing mechanism capable of pressing the internal gear to fix the internal gear, a first changeover member capable of changing over an interlocked state of the cam mechanism with respect to the spindle, the first changeover member having a first changeover position and a second changeover position, wherein rotation and percussion are applied to the spindle in the first changeover position of the first changeover member, and only rotation is applied to the spindle in the second changeover position thereof, a second changeover member for torque adjustment, capable of adjusting a pressing force of the pressing mechanism to the internal gear, and adapted to be operated to allow the internal gear to idle so as to cut off the transmission of rotation to the spindle, and a restricting member capable of fixing the internal gear, the restricting member being provided so as to be movable between a fixing position for fixing the internal gear and a canceling position for canceling fixation of the internal gear, wherein the first changeover member has a third changeover position for causing the spindle to perform only rotation, and wherein, when the first changeover member is set in the first changeover position and the second changeover position, the restricting member is moved to the fixing position, and when the first changeover member is set in the third changeover position, the restricting member is moved to the canceling position.

In addition, it is a secondary object of the present invention to provide an apparatus (e.g. a power tool, a motor-driven device, an electric equipment, etc.) which, although using two changeover members in the selection of the operating mode, is capable of realizing the simplification of the structure, lower cost, and space saving by rationally disposing the clicking mechanisms.

To achieve the above secondary object, according to the second aspect of the present invention, there is provided a changeover mechanism for changing over a plurality of operating modes of an apparatus, comprising a first changeover member and a second changeover member in a rotatable relation to each other, and a plate-shaped click-stop capable of positioning the first and second changeover members in predetermined rotational positions, the click-stop being interposed between the first and second changeover members.

Furthermore, according to the third aspect of the present invention, it is preferable that the click-stop serves as a washer having a plurality of clicking pieces respectively urged resiliently against the first and second changeover members, and the first and second changeover members have recesses in which the clicking pieces can be respectively fitted in predetermined rotational positions.

Taking the secondary object of the present invention into consideration, the percussion driver drill according to the first aspect of the present invention may be modified as follows.

It is preferable that, in the percussion driver drill, when the second changeover member is operated to allow the internal gear to idle so as to cut off the transmission of rotation to the spindle, torque adjustment of the percussion driver drill is permitted. Further, it is preferable that the first changeover member is set in one of the first changeover position, the second changeover position and the third changeover position by being rotatively operated. Further, it is preferable that the second changeover member is rotatively operated to allow the internal gear to idle. Further, it is preferable that the first changeover member and the second changeover member are disposed adjacent to each other in the axial direction of the spindle. Further, it is preferable that the first changeover member and the second changeover member are in a rotatable relation to each other, and are disposed adjacent to each other in the axial direction of the spindle, the percussion driver drill further comprises a plate-shaped click-stop capable of positioning the first and second changeover members in predetermined rotational positions, the click-stop being interposed between the first and second changeover members. Still further, it is preferable that the click-stop has clicking pieces respectively urged resiliently against the first and second changeover members, and the first and second changeover members have recesses in which the clicking pieces can be respectively fitted in predetermined rotational positions. Incidentally, it is preferable that the click-stop serves as a washer.

Furthermore, according to a first embodiment of the present invention discussed below, it is preferable that the cam mechanism includes a first cam rotating integrally with the spindle and a second cam movable only in the axial direction of the spindle, wherein the second cam is moved in the axial direction of the spindle by rotative operation of the first changeover member so that the rotation and percussion are applied to the spindle in the first changeover position, and the rotation is applied to the spindle in the second changeover position and the third changeover position.

Furthermore, according to a second embodiment of the present invention discussed below, it is preferable that the cam mechanism includes a first cam rotating integrally with the spindle and a second cam engaging with the first cam to thereby rotate, and wherein rotation of the second cam is made to be restricted or restriction of the rotation of the second cam is made to be released by rotative operation of the first changeover member so that the rotation and percussion are applied to the spindle in the first changeover position, or the rotation is applied to the spindle in the second changeover position and the third changeover position.

DETAILED DESCRIPTION OF THE PREFERRED EMBODIMENTS

Hereafter, a description will be given of a description of the embodiments of the present invention with reference to the accompanying drawings.

First Embodiment

Figure 1:
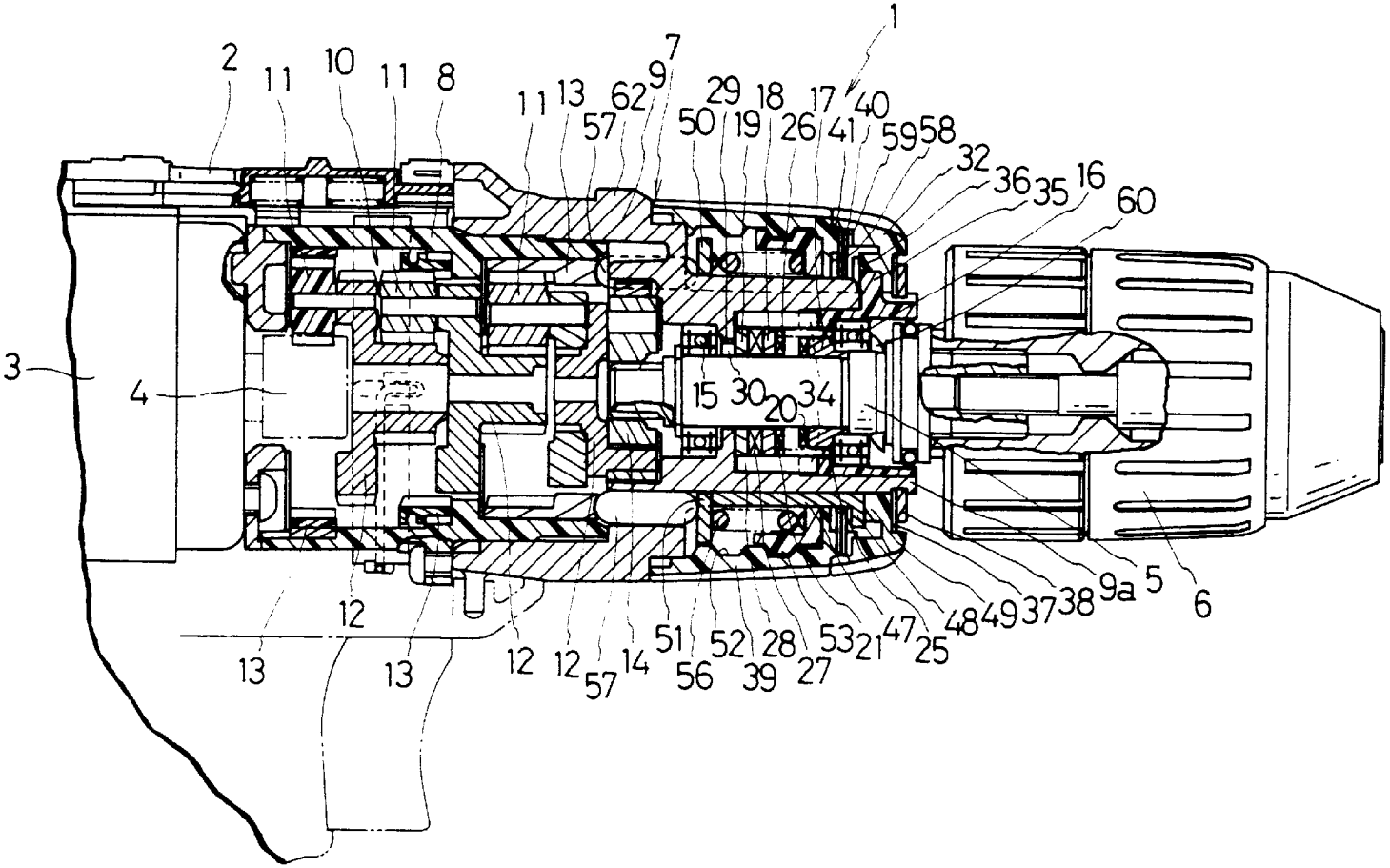
FIG. 1 is an explanatory diagram, partly in section, of a percussion driver drill in accordance with a first embodiment.

FIG. 1 is an explanatory diagram, partly in section, of a tip portion of a percussion driver drill. A percussion driver drill 1 has a motor 3 accommodated in a main body housing 2 having a pair of housing halves, and transmits the rotation from a motor shaft 4 of the motor 3 to a spindle 5 projecting forwardly of a gear assembly 7, which is assembled to the main body housing 2 from the front side (right-hand side in FIG. 1), via the gear assembly 7. A drill chuck 6 is disposed at the tip of the spindle 5. In addition, in the gear assembly 7, a known planetary gear reduction mechanism 10, in which a plurality of planetary gears 11, carriers 12 for supporting these planetary gears 11, and internal gears 13 meshing with outer peripheries of the planetary gears 11 are arranged in three stages, is accommodated inside a first gear case 8, so as to reduce the speed of the rotation of the motor shaft 4. The spindle 5 is splined to a lock cam 14 for manual tightening which is integrated with the third-stage carrier 12. The spindle 5 is pivotally supported by a second gear case 9, which is secured to the front side of the first gear case 8, by ball bearings 15 and 16.

Figure 2:
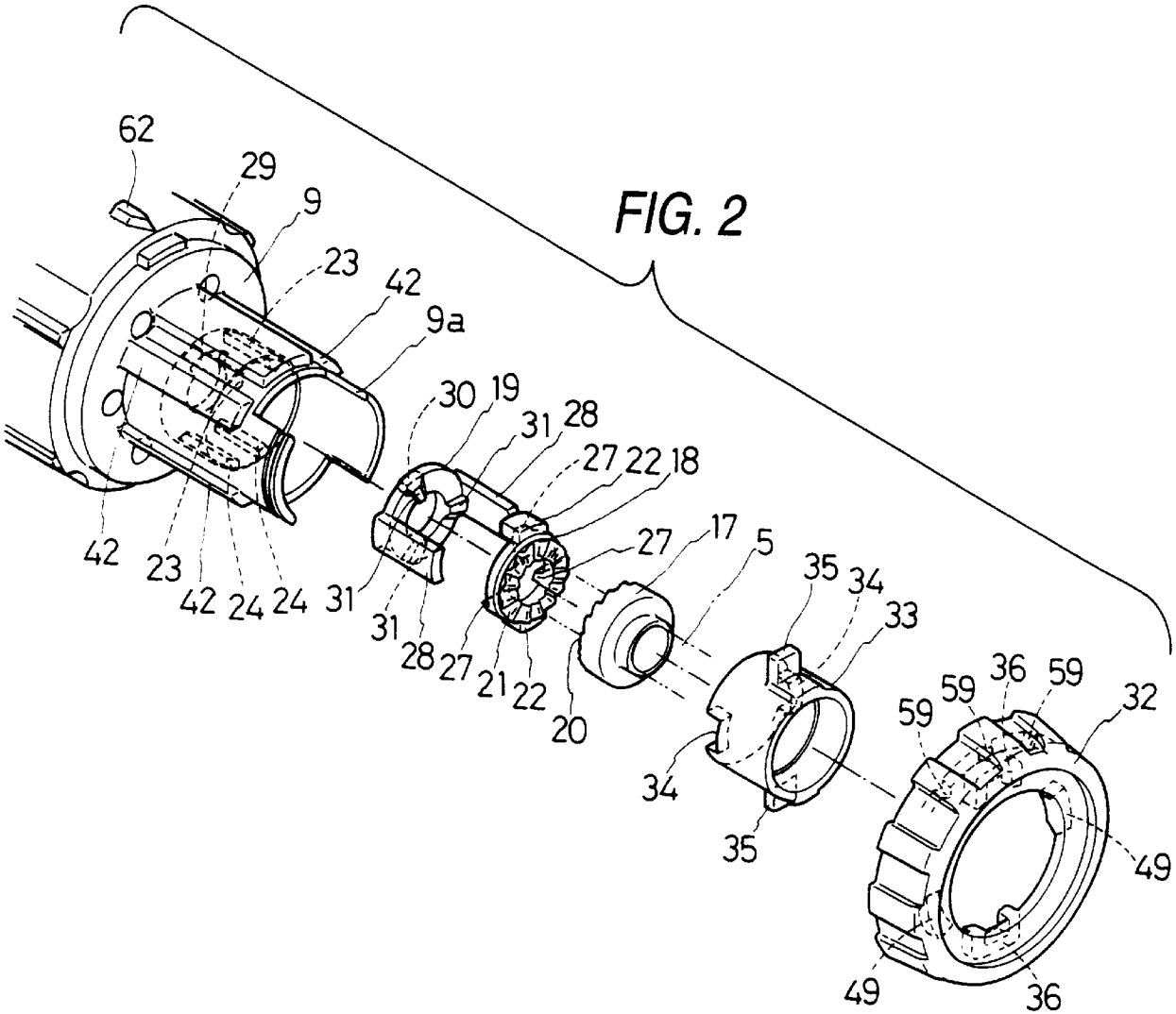
FIG. 2 is an exploded perspective view illustrating the structure concerning the changeover of the operating mode in accordance with the first embodiment.

In addition, as also shown in FIG. 2, a first cam 17, a second cam 18, and a third cam 19, in that order from the front side, are respectively fitted over and are coaxially arranged on the spindle 5 between the ball bearings 15 and 16 inside a tubular portion 9*a* of the second gear case 9. The first cam 17 is a ring member which rotates integrally with the spindle 5 and on a rear surface of which a plurality of cam teeth 20 continuing in a circular form are formed. Meanwhile, the second cam 18 is a ring member which is loosely fitted over the spindle 5, and second cam teeth 21 having the same configurations as the first cam teeth 20 are formed on its front surface opposing the first cam teeth 20. Further, the second cam 18 has a pair of guide portions 22 formed projectingly at its upper and lower positions, respectively, and is movable only in the axial direction as these guide portions 22 are respectively inserted between a pair of ribs 23 and a pair of ribs 24 formed in the axial direction on the inner surface of the second gear case 9. The second cam 18 is urged rearwardly by a coil spring 26 disposed between the second cam 18 and a flat washer 25 located on the rear surface of the ball bearing 16. In addition, three projections 27, each having an inclined surface on one circumferential side thereof (on the counterclockwise side facing the third cam 19), are provided projectingly at equal intervals on the rear surface of the second cam 18.

The third cam 19 is similarly a ring member which is disposed on the bottom surface of the tubular portion 9*a* and is loosely fitted over the spindle 5, and a pair of coupling arms 28 are formed on its left- and right-side surfaces in such a manner as to project forwardly along the inner surface of the tubular portion 9*a*. Further, a restricting piece 30 for positioning, which is inserted in a fan-shaped notch 29 formed in the bottom surface of the tubular portion 9*a* in such a manner as to continue from a through hole formed also therein for the spindle 5, is provided projectingly on the rear surface of the third cam 19, such that the third cam 19 is rotatable in the range in which the restricting piece 30 is movable in the circumferential direction. Further, three second projections 31, each having an inclined surface on the opposite side to that of the projection 27 of the second cam 18 in the circumferential direction, are provided projectingly at equal intervals on the front surface of the third cam 19. Here, if the third cam 19 is rotated in the direction toward the inclined surfaces of the second projections 31, the projections 27 of the second cam 18 respectively ride over the second projections 31 while being guided by their mutual inclined surfaces, so that the second cam 18 moves forwardly against the urging force of the coil spring 26. In this riding-over state, the second cam teeth 21 on the front surface of the second cam 18 abut against the first cam teeth 20 on the rear surface of the first cam 17.

On the other hand, the rotation of the third cam 19 is effected by a first change ring 32 serving as a first changeover member which is rotatably fitted over the front end of the tubular portion 9*a*. Namely, a tubular bearing box 33 for holding the ball bearing 16 is rotatably disposed between the spindle 5 and the tubular portion 9*a*, and the pair of coupling arms 28 of the third cam 19 are respectively engaged in a pair of notches 34 formed in the rear end of the tubular bearing box 33. A pair of coupling studs 35 provided projectingly on the upper and lower sides of this bearing box 33 are passed through the tubular portion 9*a* and are respectively grasped in a pair of grasping portions 36 in the rear surface of the first change ring 32, so that the bearing box 33 can be rotated by the rotating operation of the first change ring 32 so as to synchronize the third cam 19. It should be noted that the forward movement of the first change ring 32 is restricted by a flat washer 37 and a snap ring 38 which are fitted to the tubular portion 9*a*, and the rearward movement thereof is restricted by a second change ring 39 serving as a second changeover member which is similarly rotatably fitted over the tubular member 9*a*.

Figure 3:
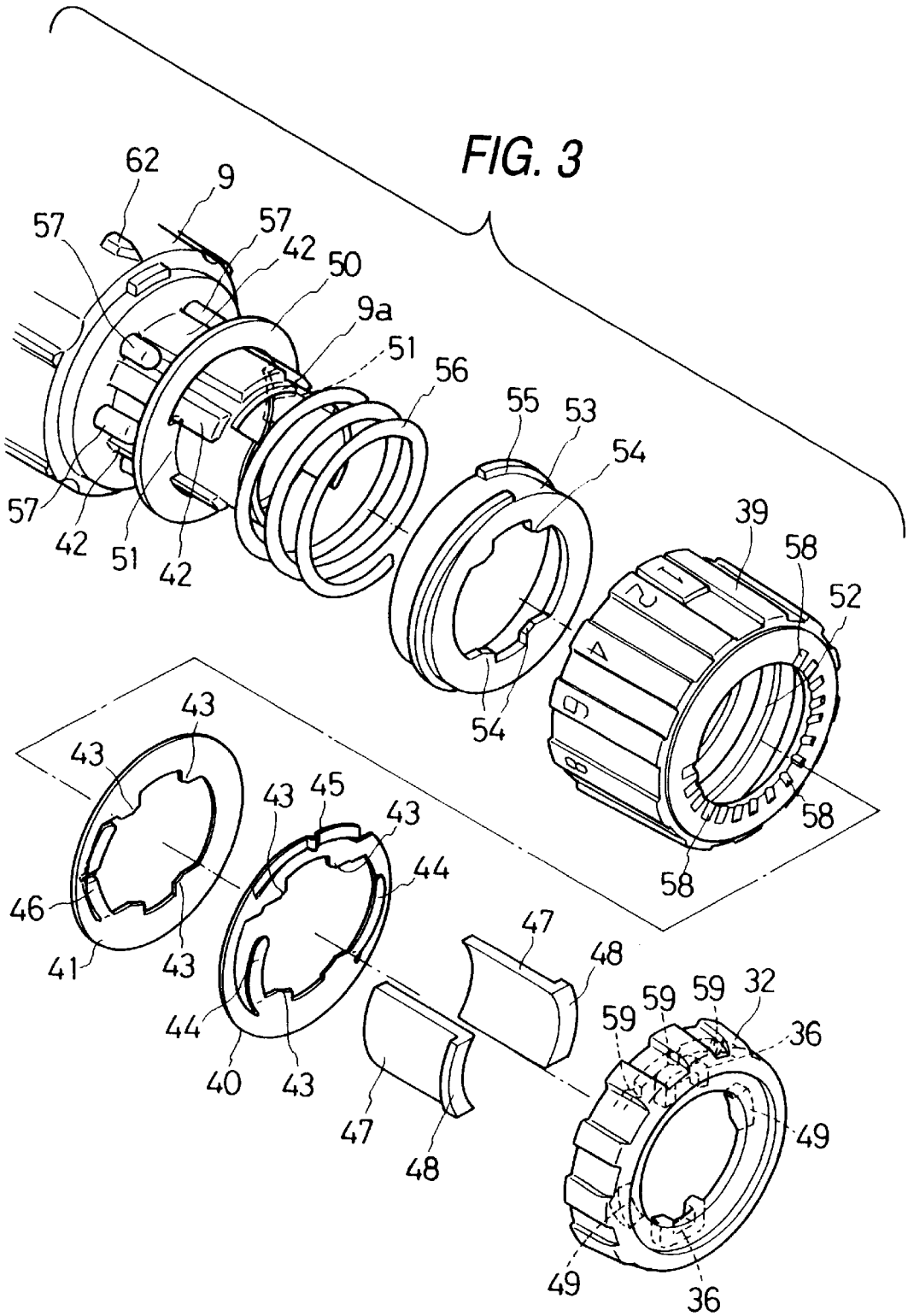
FIG. 3 is an exploded perspective view illustrating the structure concerning torque adjustment in accordance with the first embodiment.

In addition, as also shown in FIG. 3, two washers 40 and 41 serving as a click-stop are interposed between the first change ring 32 and the second change ring 39 in such a manner as to be axially superposed on each other. These washers 40 and 41 have projections 43 which are accommodated between adjacent ones of a plurality of protrusions 42 provided so as to project axially from the side surface of the tubular portion 9*a*, and the washers 40 and 41 are fitted over the tubular portion 9*a* in a state of being prevented from rotating. Formed respectively on the front washer 40 are a pair of left and right spring pieces 44 each shaped in the form of a strip configured along the outer peripheral surface of the tubular portion 9*a* and having its free end resiliently deformed forwardly, as well as a click 45 provided on an upper central portion thereof and shaped in the form of a strip which is similarly configured along the outer surface of the tubular portion 9*a* and has a central portion of its free end resiliently deformed forwardly. Meanwhile, formed on the rear washer 41 is a click 46 provided on its left-hand side facing the second change ring 39 and shaped in the form of a strip which is configured along the outer peripheral surface of the tubular portion 9*a* and has a central portion its free end resiliently deformed rearwardly.

A pair of stoppers 47 serve as restricting members which are curved along the shapes of the left and right side surfaces of the tubular portion 9*a* and are respectively disposed between adjacent ones of the protrusions 42 of the tubular portion 9*a* in such a manner as to be slidable in the back-and-forth direction. Front ends of the stoppers 47 are formed as abutment pieces 48 which are passed through the two washers 40 and 41 and rise upward on the rear surface side of the first change ring 32 perpendicularly to the axial direction. The spring pieces 44 of the washer 40 abut against these abutment pieces 48 to urge the stoppers 47 in the forward direction, thereby causing the stoppers 47 to abut against the rear surface of the first change ring 32. Meanwhile, a pair of projections 49, each having an inclined surface on one circumferential side thereof (on the clockwise side facing the rear side), are projectingly formed on the rear surface of the first change ring 32 in the manner of point symmetry. As the first change ring 32 is rotatively operated, the stoppers 47 are caused to ride over or move away from the projections 49, thereby making it possible to adjust the axial positions of the stoppers 47. It should be noted that a flat washer 50 is disposed at the root of the tubular portion 9*a* on the rear side of the stoppers 47 in such a manner as to be axially movable, and a pair of pressing pieces 51 which are accommodated between adjacent ones of the protrusions 42 on the left- and right-hand sides of the tubular portion 9*a* extend inwardly from the inner periphery of the flat washer 50. In the state in which the stoppers 47 ride over the projections 49 in conjunction with the rotation of the first change ring 32, rear ends of the stoppers 47 abut against the flat washer 50.

Meanwhile, an internally threaded portion 52 is formed on the inner periphery of the second change ring 39. A spring holder 53 having an externally threaded portion 55 formed on its outer periphery is threadedly engaged with the internally threaded portion 52, the spring holder 53 being fitted over the tubular portion 9*a* so as to be movable only in the axial direction by projections 54 accommodated between adjacent ones of the protrusions 42. Hence, as the second change ring 39 is rotatively operated, the spring holder 53 is threadedly fed in the axial direction, thereby making it possible to vary the axial length of a coil spring 56 interposed between the spring holder 53 and the flat washer 50, i.e., the pressing force acting on the flat washer 50. In addition, a plurality of pins 57, which are passed through the second gear case 9 and abut against the front surface of the third-stage internal gear 13 of the planetary gear reduction mechanism 10, are disposed in the rear of the flat washer 50. This internal gear 13 is provided rotatably inside the first gear case 8, and is fixed by the pressing force of the coil spring 56 which is transmitted thereto from the flat washer 50 by the pins 57.

Further, a plurality of recesses 58, into which the click 46 of the washer 41 can be fitted, are arranged circumferentially on the front surface of the second change ring 39, such that the click 46 is fitted to any one of the recesses 58 in the rotatable range of the second change ring 39 in which the pressing force based on the coil spring 56 is set in the range of from minimum to maximum, thereby obtaining clicking action for positioning the second change ring 39. Similarly, three recesses 59, into which the click 45 of the washer 40 can be fitted, are formed at 30° intervals on the rear surface of the first change ring 32, so as to allow the clicking action to be obtained at each position. Here, in a first changeover position (FIG. 4A) in which the click 45 is fitted in the left-end recess 59 of the first change ring 32 as the percussion driver drill 1 is viewed from the front side, the bearing box 33 and the third cam 19 are rotated clockwise, and the second projections 31 and the projections 27 are superposed on each other in the axial direction, thereby pushing the second cam 18 in the forward direction. Accordingly, the mode is set in a percussion mode in which the second cam 18 and the first cam 17 abut against each other at their first and second cam teeth 20 and 21, so that when the spindle 5 rotates, percussing motion is applied whereby the spindle 5 is moved slightly in the back-and-forth direction by the mutual interference of the cam teeth. It should be noted that reference numeral 60 shown in FIGS. 1 and 4A denotes a wave washer fitted over the spindle 5 between the ball bearing 16 and a large-diameter portion of the spindle 5 so as to provide resiliency for causing the spindle 5 during the percussion mode to return to its forwardly most advanced position in which a snap ring 61 fitted on its rear end abuts against the ball bearing 15.

Next, in a second changeover position (FIG. 4B) in which the first change ring 32 is rotated 30° counterclockwise from the percussion mode, the second projections 31 of the third cam 19, which simultaneously rotated counterclockwise, and the projections 27 of the second cam 18 move away from each other in the circumferential direction, so that the second cam 18 retracts. Therefore, the mode is set in a drill mode in which the interference between the cam teeth of the second cam 18 and the first cam 17 is canceled. Accordingly, the spindle 5 performs only rotary motion.

Figure 4A:
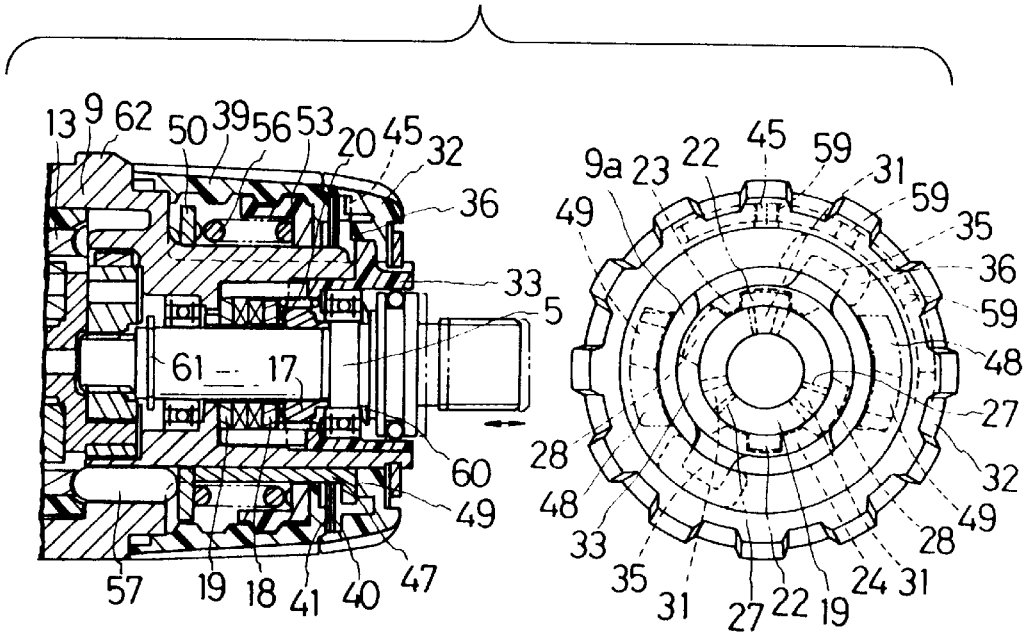
FIG. 4A is an explanatory diagram illustrating a percussion mode in the first embodiment.
Figure 4B:
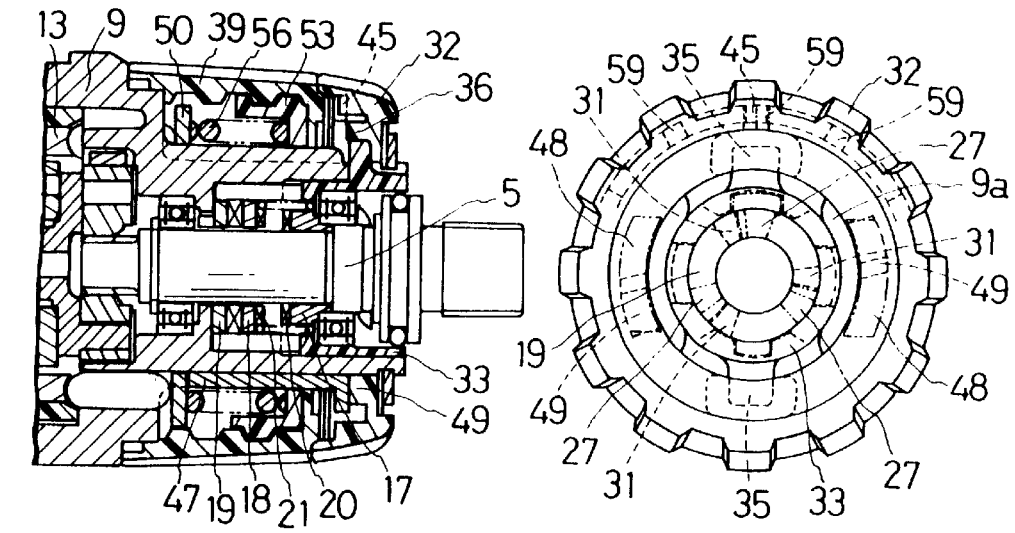
FIG. 4B is an explanatory diagram illustrating a drill mode in the first embodiment.

In addition, in the case of this drill mode and the above-described percussion mode, as shown in FIGS. 4A and 4B, the projections 49 are located in front of the stoppers 47 to press the abutment pieces 48 rearwardly, thereby causing the rear ends of the stoppers 47 to abut against the flat washer 50. Accordingly, in these operating modes, since the forward movement of the pins 57 and the flat washer 50 is prevented irrespective of the pressing force of the coil spring 56 based on the rotation of the second change ring 39, the third-stage internal gear 13 is fixed firmly.

Figure 4C:
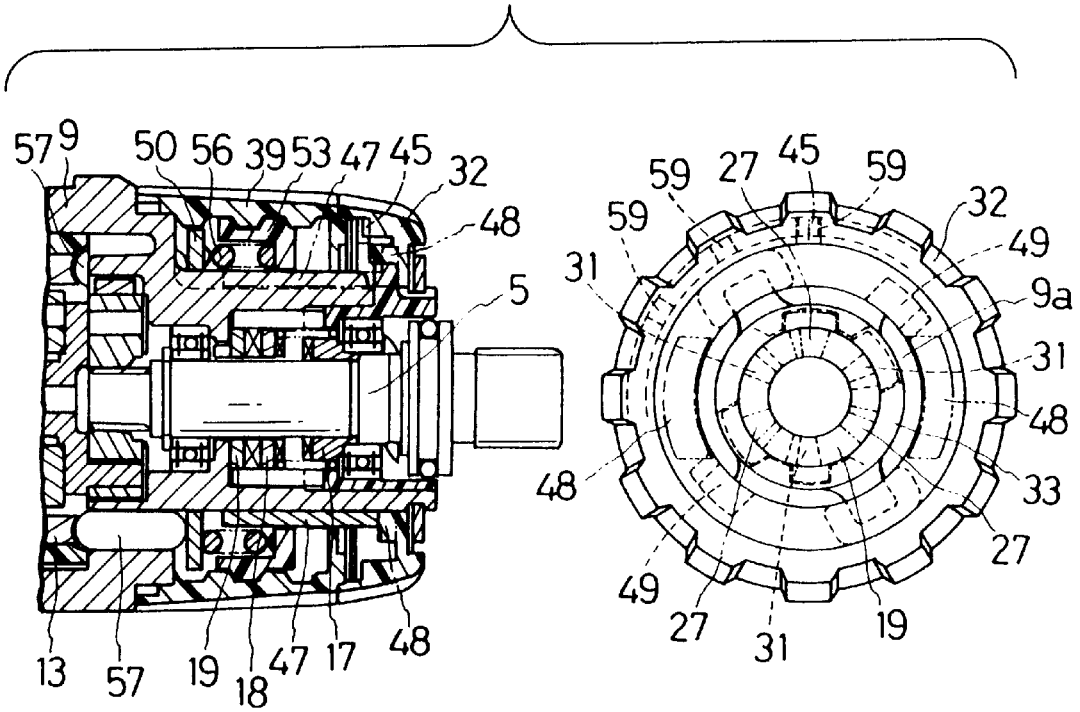
FIG. 4C is an explanatory diagram illustrating a clutch mode in the first embodiment.

Further, in a third changeover position (FIG. 4C) in which the first change ring 32 is rotated 30° counterclockwise from the drill mode, the mode is set in a clutch mode in which the projections 49 of the first change ring 32 are moved away from the abutment pieces 48 of the stoppers 47 with the second projections 31 of the third cam 19 and the projections 27 of the second cam 18 moved away from each other, and the stoppers 47 are moved forwardly by the urging force of the spring pieces 44, thereby canceling the pressing of the flat washer 50. In this clutch mode, since the internal gear 13 is fixed only by the pressing force of the coil spring 56 by the flat washer 50 and the pins 57, when the load on the spindle 5 increases such as at the time of finishing screwdriving, and the pressing force of the internal gear 13 by the coil spring 56 is hence exceeded, the pins 57 and the flat washer 50 are pushed upward, so that the internal gear 13 idles, thereby cutting off the transmission of rotation to the spindle 5. Accordingly, in a case where torque adjustment is made for allowing such clutch operation to act, it suffices if the second change ring 39 is rotated to a desired position (numbers indicating the strengths of torque are inscribed in steps on the side surface of the second change ring 39, and an arrow 62 for setting the number is provided projectingly on the side surface of the second gear case 9), to thereby change the pressing force of the coil spring 56.

Thus, in accordance with the first embodiment, the arrangement provided is such that the stoppers 47 for fixing the internal gear 13 by coming into direct contact with the flat washer 50 are provided separately from the torque-adjusting coil spring 56, and the clutch mode (the third changeover position) is set for the first change ring 32 so as to control the stoppers 47 between the percussion or drill mode and the clutch mode by the rotating operation of the first change ring 32. Therefore, the cancelation of the clutch which is necessary for the percussion mode and the drill mode can be effected irrespective of the position of torque adjustment by the second change ring 39, and a situation can be prevented in which the clutch is accidentally operated during the percussion mode and the drill mode. Accordingly, a changeover among the three operating modes including the percussion mode, the drill mode, and the clutch mode (torque adjustment) can be effected simply and reliably merely by the operation of the first change ring 32, so that the percussion driver drill 1 in accordance with this embodiment excels in the ease of use.

In addition, since the first change ring 32 and the second change ring 39 are arranged adjacent to each other in the axial direction, and the washers 40 and 41 serving as a click-stop are accommodated between the two change rings, it goes without saying that clicking action can be obtained at the changeover positions provided by the respective change rings, and two clicking mechanisms can be accommodated at one location in a small space. Hence, the structure can be simplified, and the assembly facilitated, thereby making it possible to realize low manufacturing cost. In addition, the percussion driver drill 1 is prevented from becoming axially elongated. In particular, since the clicking pieces 45 and 46 are respectively formed on the washers 40 and 41 and are fitted in the recesses 58 and 59 in the change rings, the a click-stop can be arranged simply in a smaller space.

It should be noted that although, in the above-described embodiment, the washer 40 for the first change ring 32 and the washer 41 for the second change ring 39 are respectively provided in light of the need to provide the spring pieces 44 for urging the stoppers 47, in a percussion driver drill which does not use the stoppers 47 or in which a different urging mechanism is provided, the washers may be formed as one piece as the click-stop, and the clicking pieces 45 and 46 may be formed collectively. According to this arrangement, it is possible to attain further simplification of the structure and a further reduction in cost.

In addition, insofar as predetermined clicking action can be obtained by the click-stop interposed between the changeover members, changes in design can be made appropriately such as by providing a plurality of clicking pieces opposing each change ring or by reversing the positional arrangement of the first change ring 32 and the second change ring 39.

By citing the first embodiment of the percussion driver drill as one example, a description has been given of at least one clicking mechanism which is interposed between the first changeover member and the second changeover member that are rotatable and which is capable of positioning the changeover members at predetermined rotational positions. However, in view of the highest concept of the present invention, the arrangement concerning the rational disposition of the clicking mechanisms, including such as the first changeover member, the second changeover member, and the clicking pieces, should not be merely limited to component elements of the percussion driver drill. Namely, this arrangement may be applied to other apparatuses requiring the changeover members (e.g., power tools, electronic equipment, etc.), and should not be limited to uses in which the changeover members are directed to the change of the operating mode and torque adjustment as in the first embodiment of the percussion driver drill and also in a second embodiment of the percussion driver drill which will be described below.

Second Embodiment

Next, a description will be given of another embodiment of the percussion driver drill. It should be noted that since the same reference numerals as those used in the first embodiment denote the same component parts, a description thereof will be omitted.

Figure 5:
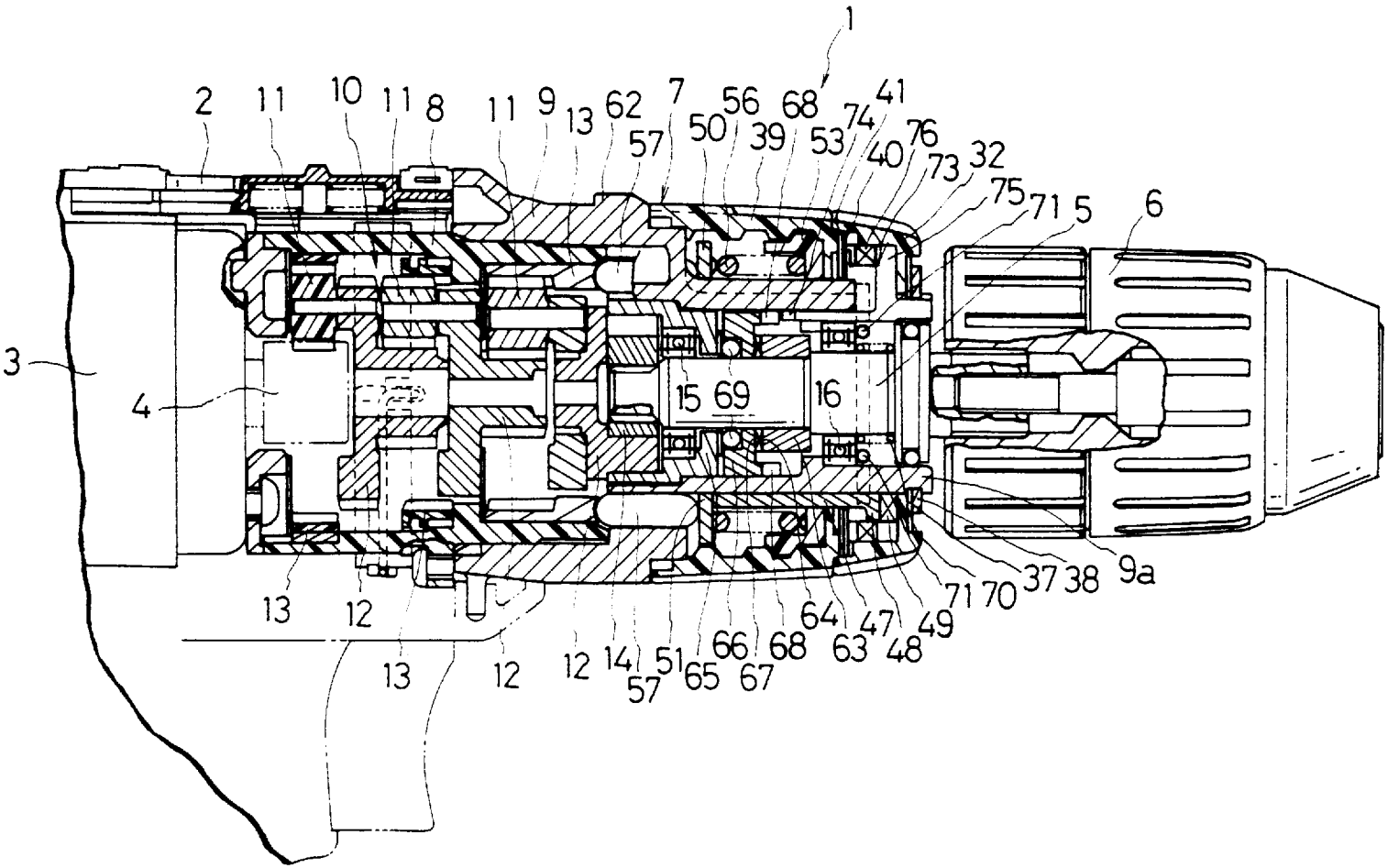
FIG. 5 is an explanatory diagram, partly in section, of a percussion driver drill in accordance with a second embodiment.
Figure 6:
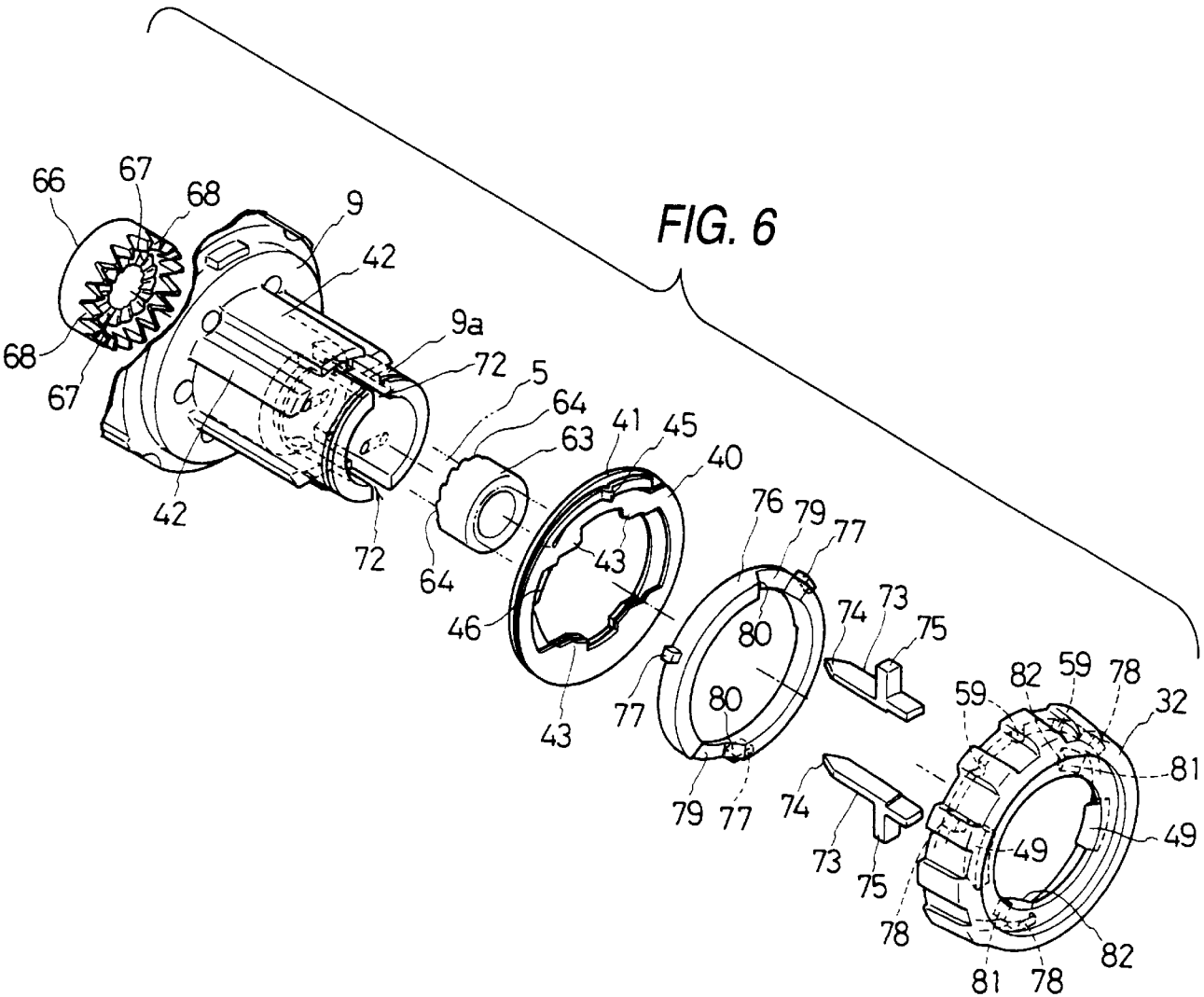
FIG. 6 is an exploded perspective view illustrating the structure concerning the changeover of the operating mode in accordance with the second embodiment.

In FIGS. 5 and 6, an annular first cam 63 is secured to the spindle 5 inside the tubular portion 9*a* between the ball bearings 15 and 16 in such a manner as to be integrally rotatable, and first cam teeth 64 are formed on a rear surface of the first cam 63. Further, a second cam 66 which is fitted loosely over the spindle 5 is disposed in the rear of the first cam 63 and in front of a lock ring 65 for closing the tubular portion 9*a,* and has on its front surface second cam teeth 67 meshing with the first cam teeth 64 as well as engaging teeth 68 formed on an outer periphery of the second cam teeth 67. Steel balls 69 are interposed between the second cam 66 and the spindle 5. A coil spring 70 is disposed between the large-diameter portion of the spindle 5 and the ball bearing 16 to urge the spindle 5 toward its forwardly most advanced position. A pair of pins 71 are passed through the tubular portion 9*a* perpendicularly thereto so as to fix the ball bearing 16.

Meanwhile, a pair of upper and lower slots 72 are formed in a front end of the tubular portion 9*a* in such a manner as to extend in the axial direction, and a pair of change levers 73 are respectively accommodated in the slots 72 so as to be movable therein. Each of the change levers 73 has a pawl 74 at its rear end extending along the inner periphery of the tubular portion 9*a,* the pawl 74 being engageable with the engaging teeth 68 of the second cam 66, and also has on its intermediate portion a coupling piece 75 projecting in the radial direction of the tubular portion 9*a* through the slot 72. Here, a cam ring 76 is interposed between the first change ring 32 and the washer 40, and the coupling pieces 75 are inserted between the cam ring 76 and the first change ring 32. This cam ring 76 is a ring member which is integrated with the first change ring 32 as three projections 77 on the outer periphery of the cam ring 76 are fitted in three recesses 78 formed in the first change ring 32. A pair of stepped portions are formed on the front surface of the cam ring 76 so as to be located in the manner of point symmetry, wherein low portions of the stepped portions are formed as a pair of arcuate portions 79, and one sides of the respective arcuate portions 79 of the stepped portions are formed as a pair of inclined surfaces 80 similarly located in the manner of point symmetry. Further, in addition to the pair of projections 49 for retracting the stoppers 47, a pair of projections 81, each having an inclined surface 82 which is parallel to the inclined surface 80 with such an interval that the coupling piece 75 is capable of passing therebetween, are formed on the rear surface of the first change ring 32. As the first change ring 32 is rotated, the coupling pieces 75 are respectively guided by the inclined surfaces 80 and 82, and perform relative movement between a riding-over position where the coupling pieces 75 ride over the projections 81 and a dislocated position where they are dislocated from the projections 81 so as to change the axial positions of the change levers 73, thereby allowing the pawls 74 to be engageable with or disengageable from the engaging teeth 68 of the second cam 66.

Figure 7A:
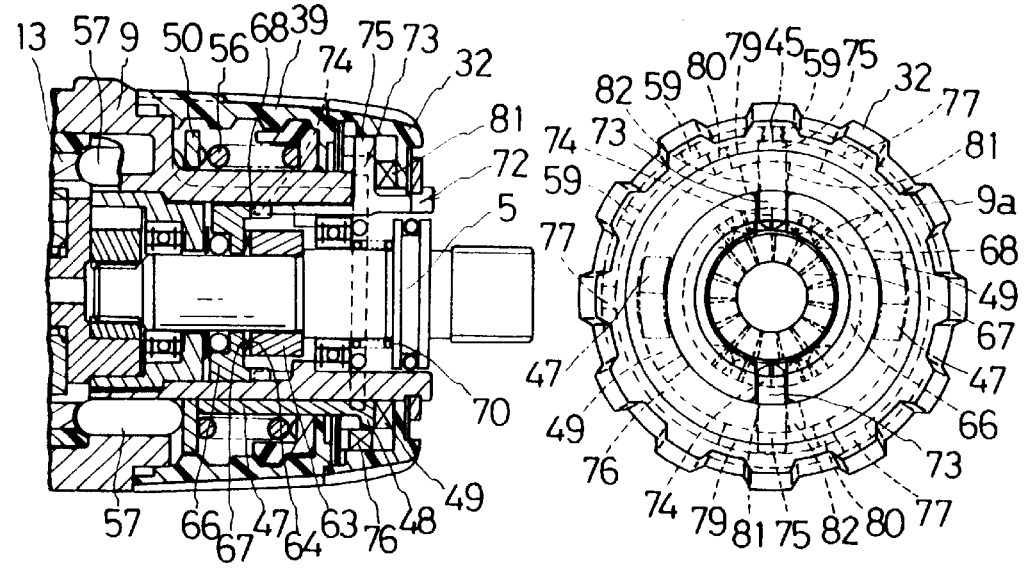
FIG. 7A is an explanatory diagram illustrating the percussion mode in the second embodiment.
Figure 7B:
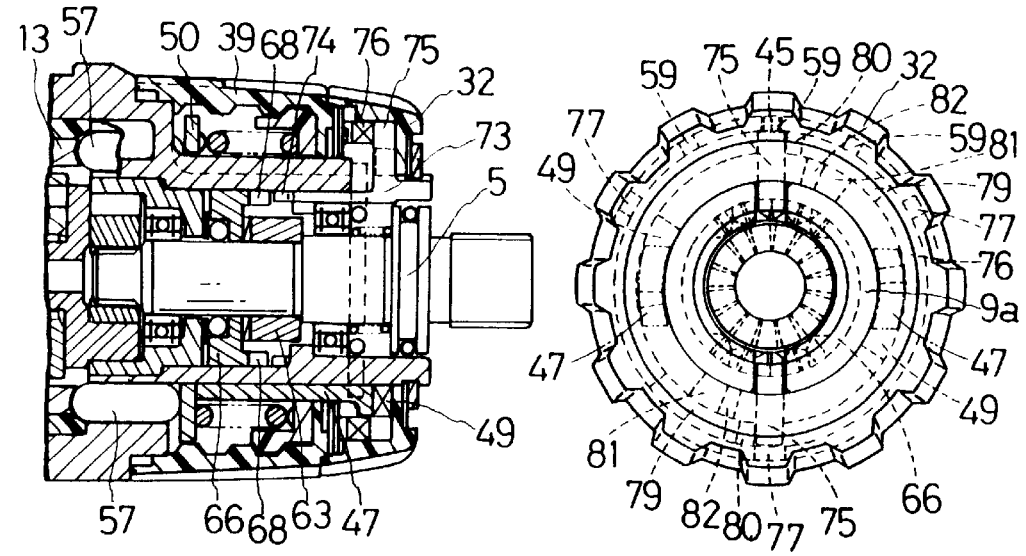
FIG. 7B is an explanatory diagram illustrating the drill mode in the second embodiment.

Accordingly, in the second embodiment, in the first changeover position (FIG. 7A) in which the click 45 is fitted in the right-end recess 59 of the first change ring 32 as the percussion driver drill 1 is viewed from the front side, the coupling pieces 75 ride over the projections 81 while being guided by the inclined surfaces 80 and 82, so that the change levers 73 retract. Then, the pawls 74 at the rear ends engage with the engaging teeth 68 of the second cam 66 to restrict the rotation of the second cam 66, so that the first cam teeth 64 of the first cam 63, which rotates integrally with the spindle 5, interferes with the second cam teeth 67 of the second cam 66, thereby setting the mode to the percussion mode in which the spindle 5 moves back and forth in conjunction with its rotation. In addition, in the second changeover position (FIG. 7B) in which the first change ring 32 is rotated 30° clockwise therefrom, the projections 81 move away from in front of the coupling pieces 75, and the coupling pieces 75 move forwardly while being guided between the inclined surfaces 80 and 82, thereby forwardly advancing the change levers 73. Accordingly, the second cam 66 which is thus unlocked from the pawls 74 becomes freely rotatable, so that the mode is set in the drill mode in which the spindle 5 effects only the rotation. It should be noted that, in the case of the percussion mode and the drill mode, since the projections 49 press the stoppers 47 rearwardly and cause them to abut against the flat washer 50, the third-stage internal gear 13 is firmly fixed irrespective of the torque set by the second change ring 39.

Figure 7C:
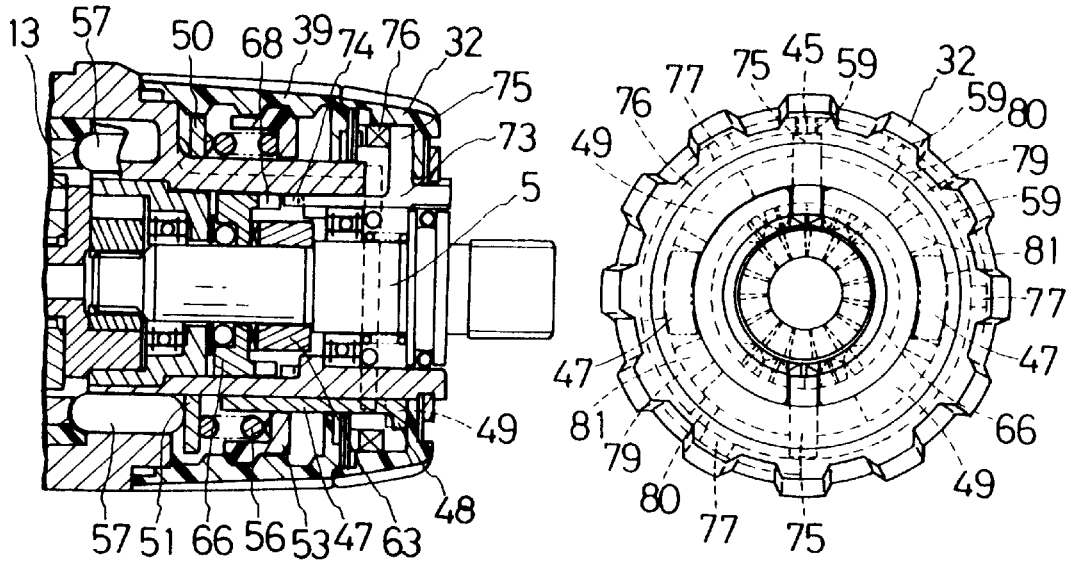
FIG. 7C is an explanatory diagram illustrating the clutch mode in the second embodiment.

Further, in the third changeover position (FIG. 7C) in which the first change ring 32 is rotated 30° clockwise from the drill mode, since the projections 49 of the first change ring 32 are moved away from the stoppers 47 with the positions of the change levers 73 kept as they are, and the forward movement of the flat washer is thus allowed. As a result, the mode is set in the clutch mode in which the torque of the spindle 5 can be adjusted by the change of the pressing force of the coil spring 56 through the operation of the second change ring 39.

Thus, in the second embodiment as well, in the same way as the first embodiment, the arrangement provided is such that the stoppers 47 for fixing the internal gear 13 by coming into direct contact with the flat washer 50 are controlled by the rotating operation of the first change ring 32 independently of the torque-adjusting coil spring 56. Therefore, the cancelation of the clutch which is necessary for the percussion mode and the drill mode can be effected irrespective of the position of torque adjustment by the second change ring 39, and a situation can be prevented in which the clutch is accidentally operated during the percussion mode and the drill mode. Accordingly, a changeover among the three operating modes including the percussion mode, the drill mode, and the clutch mode can be effected simply and reliably merely by the operation of the first change ring 32, so that the percussion driver drill 1 in accordance with this embodiment excels in the ease of use.

It should be noted that the number and the shape of the stoppers 47 serving as the restricting members and the number and the shape of the projections 49 corresponding thereto are not limited to those of the first and second embodiments. For example, modifications may be made, as required, such as by disposing the restricting members at four locations or by forming the restricting members not in the plate shape but in a bar shape insofar as the restricting members are capable of restricting the rotation of the internal gear 13 and of cancelling the restriction by moving back and forth in the axial direction between the first and second changeover positions and the third changeover position of the first change ring 32. In addition, the structure pertaining to torque adjustment is not limited to those illustrated in the first and second embodiments, either. For example, one steel ball or a plurality of steel balls superposed one on top of another in the axial direction may be used instead of the pins 57, or an arrangement based on the meshing of teeth having inclined surfaces may be adopted.

Thus, in accordance with the present invention, the arrangement provided is such that the restricting member capable of fixing the internal gear is provided separately from the torque-adjusting pressing mechanism, and the third changeover position for causing the spindle to perform only rotation is set for the first changeover member so as to control the movement of the restricting member by operating the first changeover member. Therefore, the cancelation of the torque adjustment function necessary for the percussion mode and the drill mode, which are selected in the first and second changeover positions, can be effected irrespective of the position of torque adjustment by the second changeover member, and a situation can be prevented in which the torque adjustment accidentally functions during the percussion mode and the drill mode. Accordingly, a changeover among the three operating modes including the percussion mode, the drill mode, and the torque adjustment can be effected simply and reliably merely by the operation of the first changeover member, so that the percussion driver drill in accordance with this embodiment excels in the ease of use.

In addition, in accordance with the present invention, since the first changeover member and the second changeover member are disposed adjacent to each other in the axial direction, and a plate-shaped click-stop capable of positioning the changeover members in predetermined rotational positions is interposed between the two changeover members, it goes without saying that clicking action can be obtained at the changeover positions provided by the respective changeover members, and the space for the clicking mechanisms can be collectively formed at one location. Hence, the structure can be simplified, and the assembly facilitated, thereby making it possible to realize low manufacturing cost. In addition, the percussion driver drill is prevented from becoming axially elongated.

Furthermore, in accordance with the present invention, in addition to the above-described advantages, since the click-stop is formed as a washer which is provided unrotatably and on which clicking pieces for being respectively urged resiliently against the changeover members are formed, and recesses in which the clicking pieces can be respectively fitted in predetermined rotational positions are respectively formed in the changeover members, the click-stop can be constructed simply in a smaller space.

What is claimed is:

1. A percussion driver drill, comprising:

a main body housing to which a motor is attached;

a planetary gear reduction mechanism assembled to the main body housing, the planetary gear reduction mechanism having an internal gear rotatably disposed therein, an input end capable of being mounted on the motor, and an output end from which a rotational force is transmissible to a spindle;

a cam mechanism capable of applying percussing motion to the spindle in an axial direction thereof in interlocking relation to the spindle;

a pressing mechanism capable of pressing the internal gear to fix the internal gear;

a first changeover member capable of changing over an interlocked state of the cam mechanism with respect to the spindle, the first changeover member having a first changeover position and a second changeover position, wherein rotation and percussion are applied to the spindle in the first changeover position of the first changeover member, and only rotation is applied to the spindle in the second changeover position thereof;

a second changeover member for torque adjustment, capable of adjusting a pressing force of the pressing mechanism to the internal gear, and adapted to be operated to allow the internal gear to idle so as to cut off the transmission of rotation to the spindle; and a restricting member capable of fixing the internal gear, the restricting member being provided so as to be movable between a fixing position for fixing the internal gear and a canceling position for canceling fixation of the internal gear, wherein the first changeover member has a third changeover position for causing the spindle to perform only rotation, and wherein, when the first changeover member is set in the first changeover position and the second changeover position, the restricting member is moved to the fixing position, and when the first changeover member is set in the third changeover position, the restricting member is moved to the canceling position.

2. The percussion driver drill of claim 1, wherein the first changeover member is set in one of the first changeover position, the second changeover position and the third changeover position by being rotatively operated.

3. The percussion driver drill of claim 1, wherein the first changeover member and the second changeover member are disposed adjacent to each other in the axial direction of the spindle.

4. The percussion driver drill of claim 1, wherein the first changeover member and the second changeover member are in a rotatable relation to each other, and are disposed adjacent to each other in the axial direction of the spindle, the percussion driver drill further comprises a plate-shaped click-stop capable of positioning the first and second changeover members in predetermined rotational positions, the click-stop being interposed between the first and second changeover members.

5. The percussion driver drill of claim 4, wherein the click-stop has clicking pieces respectively urged resiliently against the first and second changeover members, and the first and second changeover members have recesses in which the clicking pieces can be respectively fitted in predetermined rotational positions.

6. The percussion driver drill of claim 1, wherein the first changeover member is set by being rotatively operated in one of the first changeover position, the second changeover position and the third changeover position, and the cam mechanism includes a first cam rotating integrally with the spindle and a second cam movable only in the axial direction of the spindle, and wherein the second cam is moved in the axial direction of the spindle by rotative operation of the first changeover member so that the rotation and percussion are applied to the spindle in the first changeover position, and the rotation is applied to the spindle in the second changeover position and the third changeover position.

7. The percussion driver drill of claim 1, wherein the first changeover member is set by being rotatively operated in one of the first changeover position, the second changeover position and the third changeover position, and the cam mechanism includes a first cam rotating integrally with the spindle and a second cam engaging with the first cam to thereby rotate, and wherein rotation of the second cam is made to be restricted or restriction of the rotation of the second cam is made to be released by rotative operation of the first changeover member so that the rotation and percussion are applied to the spindle in the first changeover position, or the rotation is applied to the spindle in the second changeover position and the third changeover position.

* * * * *